US005414218A

United States Patent [19]

Nathan

[11] Patent Number: 5,414,218

[45] Date of Patent: May 9, 1995

[54] ARRANGEMENT FOR CABLE TENSILE STRAIN RELIEF

[75] Inventor: Robert Nathan, Backnang, Germany

[73] Assignee: Alfred Karcher GmbH & Co., Winnenden, Germany

[21] Appl. No.: 956,873

[22] PCT Filed: Jun. 11, 1991

[86] PCT No.: PCT/EP91/01088

§ 371 Date: Dec. 7, 1992

§ 102(e) Date: Dec. 7, 1992

[87] PCT Pub. No.: WO91/20111

PCT Pub. Date: Dec. 26, 1991

[30] Foreign Application Priority Data

Jun. 13, 1990 [DE] Germany ..... 40 18 905.9

[51] Int. Cl.[6] ..... H01B 17/16

[52] U.S. Cl. ..... 174/15.1; 174/140 R

[58] Field of Search ..... 174/151, 137 R, 152 R, 174/152 G, 153 R, 153 G, 137 B, 140 R, 140 C, 140 S, 154, 163 R, 168, 172, 135, 136

[56] References Cited

U.S. PATENT DOCUMENTS

| | | | |
|---|---|---|---|
| 1,406,698 | 2/1922 | Steinberger | 174/140 S |
| 2,506,431 | 5/1950 | Perret et al. | 427/250 |
| 2,717,792 | 9/1955 | Pelley | 403/69 |
| 2,893,722 | 7/1959 | Beck | 267/153 |
| 2,895,003 | 7/1959 | Rapata | 174/153 G |
| 3,141,062 | 7/1964 | Rapata | 174/153 G |
| 3,155,770 | 11/1964 | Hollenden et al. | 427/250 |
| 3,424,856 | 1/1969 | Coldren | 174/153 G |
| 3,499,097 | 3/1970 | Widstran | 174/65 G |
| 3,961,833 | 6/1976 | Schmitz | 174/135 |
| 4,033,535 | 7/1977 | Moran | 174/153 G X |
| 4,275,035 | 6/1981 | Leonhardt | 422/250 |
| 4,460,227 | 7/1984 | Ball | 174/152 G X |
| 4,493,467 | 1/1985 | Borja | 174/153 G X |

FOREIGN PATENT DOCUMENTS

| | | |
|---|---|---|
| 200636 | 5/1958 | Austria . |
| 2340314 | 2/1975 | Germany . |
| 2748419 | 6/1978 | Germany . |
| 3308332 | 9/1984 | Germany . |
| 3409906 | 9/1985 | Germany . |
| 3447226 | 7/1986 | Germany . |
| 3826474 | 2/1990 | Germany . |

OTHER PUBLICATIONS

"Technik rund ums Kabel," U. I. Lapp KG, Catalog A32, Mar. 1988.

*Primary Examiner*—Leo P. Picard
*Assistant Examiner*—Christopher Horgan
*Attorney, Agent, or Firm*—Barry R. Lipsitz

[57] ABSTRACT

A cable tensile strain reliever comprising a cable sheath which is attached its attachment to a body absorbing the tensile strain and a clamping part for constricting the cable and fixing it relative to the sheath, which not only provides adequate strain relief at high tensile loads but also ensures reliable protection against buckling and which is of simple construction and very stable.

25 Claims, 3 Drawing Sheets

ARRANGEMENT FOR CABLE TENSILE STRAIN RELIEF

Figure 1:
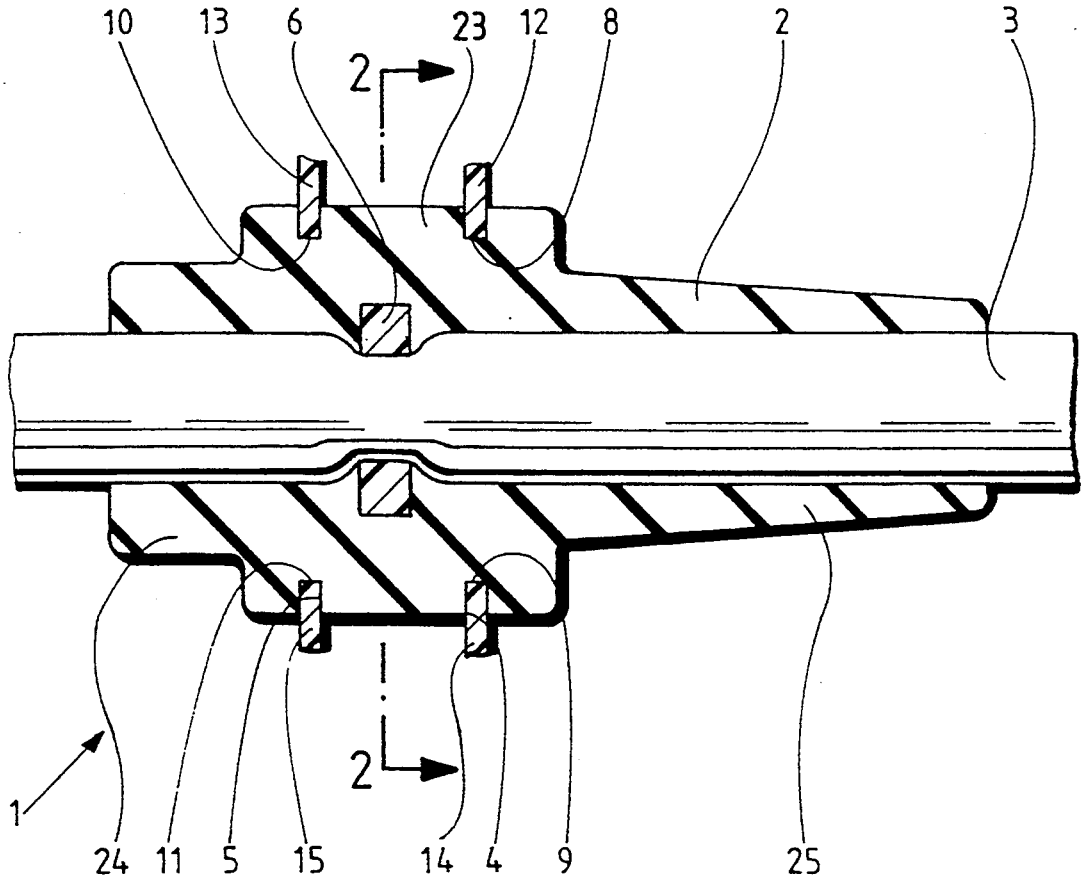

The invention relates to an arrangement for cable tensile strain relief comprising a cable, a cable sheath, means for attaching it to a body absorbing the tensile strain and a clamping part for constricting the cable and fixing it relative to the sheath.

Different designs for cable tensile strain relievers or cable passages with strain relief are known. For example, DE-OS 23 40 314 describes a cable passage with strain relief, in which a holding element consisting, for example, of an elastic plastic material is seated in an opening in a housing wall, this element being coated onto the cable. In the case of multiwired cables, the outer cable casing is removed in the region of the coating and the casings around the individual wires are roughened so that an adequate tensile strain relief is ensured for the individual wires.

DE-OS 27 48 419 describes a seal for a submersible motor or the like. The seal closes an opening in the housing for the motor, through which a sheathed electrical cord is guided. Associated with the seal are a short piece of pipe coaxially surrounding the opening and attached to the inside of the housing and a cylindrical sealing element made of an elastomeric material and having an axial passage for the sheathed cord. The external diameter of the sealing element is greater than the internal diameter of the pipe, and the diameter of the axial passage is greater than the external diameter of the sheath. If the sealing element is pressed into the pipe, the diameter of the passage is reduced, and the sealing element presses against the sheath. Moreover, a clamping ring is attached to the sheathed cord in the interior of the housing such that it comes into contact with the sealing element when the cord is drawn outwards in relation to the housing.

DE-OS 34 09 906 describes a cable bushing for holding in position and reinforcing a cable guided through an opening of an appliance. The cable bushing consists of an elongated hollow body made from a resilient material and has, in the region of the opening, a bulge with a groove arranged therein. The internal diameter of the hollow body is, at least at a point of clamping, smaller than the external diameter of the cable. The opening has a funnel-shaped extension within the appliance. The bulge of the hollow body rests on the extension within the groove. If the cable is drawn outwards in relation to the housing, the bulge is pressed against the funnel-shaped extension and, therefore, the diameter of the hollow body is reduced in the region of the extension. Consequently, the more the cable is drawn, the more the hollow body is pressed against the cable.

Finally, in a catalogue ("Technik rund ums Kabel, Katalog A 32, März 1988"=Technology All Around The Cable, Catalogue A 32, March 1988) of the company U. I. Lapp KG in Stuttgart, a nylon binder is recommended for a good tensile strain relief, i.e. a nylon band which is wound around a cable bushing surrounding the cable such that the bushing is constricted and pressed against the cable.

DE-38 26 474 A1 describes an arrangement for cable tensile strain relief, in which the cable is surrounded by a casing bearing on its inner side projections which can be pressed into the cable sheathing. Such an arrangement results in the cable being fixed in position and relieved of tensile strain only when it is inserted into a housing since the sheathing is pressed against the cable only due to the insertion into the housing. It is difficult to insert this arrangement for cable tensile strain relief into the housing since the sheathing must be pressed forcibly against the cable to make an insertion even possible. This can cause a longitudinal displacement of the cable relative to the sheathing which may be undesired.

The object of the invention is to specify an arrangement for cable tensile strain relief which not only provides adequate strain relief at high tensile loads but also ensures reliable protection against buckling and which is of simple construction and very stable.

This object is accomplished in accordance with the invention, in an arrangement for cable tensile strain relief of the type specified at the outset, in that the separate clamping part rests against the cable and that the sheath encloses the clamping part and a cable portion including the constricted region.

When using the inventive arrangement for cable tensile strain relief, the individual wires of a multiwired cable are reliably relieved of strain. It is not necessary during its use to roughen the cable at the point where the clamping part engages or, in the case of multiwired cables, to remove the cable sheathing at the point where the clamping part is intended to engage. The cable is squeezed by the clamping part anchored in the sheath such that the individual wires are relieved of strain in the direction towards the sheath.

Advantageously, the sheath is integrally formed onto the clamping part and the cable portion by spray-coating. When this method is used, the production of the inventive cable tensile strain reliever is particularly simple because any finishing following the spray-coating is superfluous. Since the sprayed-on material seamlessly adjoins the surfaces of clamping part and cable portion, the anchoring of clamping part and cable portion in the sheath is also improved still more by the spray-coating.

It is favourable for the clamping part to have a U-shaped profile, wherein the distance between the arms is less than the diameter of the cable in the non-constricted state, and for the cable to be held between the two arms. The clamping part shaped in this manner is easy to mount and can also be constructed without problem to be so solid that it is capable of exerting considerable pressure on the cable. It is—and with it the clamped cable, as well—rigidly anchored in the sheath due to its shape.

In another, advantageous development of the inventive arrangement for cable tensile strain relief, the clamping part is designed as a sleeve pressed together at at least one point to such an extent that the smallest distance between opposite regions of the sleeve inner wall is less than the diameter of the cable in the non-constricted state. The cable is guided through the sleeve. The anchoring of the clamping part designed in this manner in the sleeve can be improved still further when the sleeve has at least one terminal, flange-like expanded portion.

Advantageously, the sleeve consists of a flexible plastic material or a rubber-like material. These materials are easy to spray on in the non-hardened state and can subsequently be polymerized or vulcanized. In this respect, plastic materials from the group polyvinyl chloride, polyurethane and a mixture of the two materials are particularly favourable.

Advantageously, the clamping part can consist both of a material permanently deforming during bending as well as of an elastic material. This possibility of selection also offers many possibilities for varying production of the cable tensile strain reliever, in particular, when the sheath is produced by means of spray-coating. If the clamping part consists of a material which is permanently deformed, the cable is pressed together with the clamping part and, subsequently, the cable is placed in the spray mold with the clamping part mounted. If the clamping part consists of an elastic material, it is necessary for a device pressing the clamping part and the cable together to be present in the spray mold, whereby the shape of the clamping part and the cable produced thereby is "frozen" during spray-coating.

The clamping part advantageously consists of a metal or a plastic having a higher melting point than the sheath material.

It is favourable for the means for attaching the arrangement for cable tensile strain relief to be integrally formed directly on and/or secured in position on the sheath. Additional advantageous developments of the means are given when the means forms enlargements projecting from the sheath, when the means have at least two limits facing one another and are adapted to the body in such a manner that when the cable tensile strain reliever is attached to the body the two limits rest against at least one wall of the body, and when each of the two specified limits and a region of the sheath adjacent thereto and not belonging to an enlargement engage around an edge of the wall. All the structural elements required in these developments, which must be produced on or in the sheath, can be integrally formed directly during spray-coating of the clamping part and the cable portion. It is not necessary to provide special measures on the body, which is intended to absorb the tensile strain, for receiving the inventive cable tensile strain reliever. Cable tensile strain relievers designed in this manner may be attached very easily to the body.

The inventive arrangement for cable tensile strain relief can be advantageously used when the body is designed as a housing having a passage for the cable, when the sheath fits into the passage in regions, when the means are constructed such that they engage with the specified limits on the wall of the housing limiting the passage when the cable tensile strain reliever is inserted into the passage. If the cable tensile strain reliever is inserted into the passage which is required anyway for inserting the cable into the housing, a particularly stable attachment of the cable tensile strain reliever to the housing can be achieved in a simple manner.

If the passage is formed of at least one pair of two contiguous recesses in a housing dome and a lower housing portion, respectively, then the inventive cable tensile strain reliever is equipped in an advantageous way such that the facing limits of the means form the walls of at least one annular groove, that the annular groove has a width adapted to the thickness of the wall (walls) of the housing dome and the lower housing portion, respectively, that the outer and inner contours of the annular groove are geometrically approximately similar to the opening formed by the one pair of recesses and that the inner diameter of the annular groove is equal in size to or smaller than the diameter of the passage and its outer diameter is greater than the diameter of the passage. The annular groove is produced during the spray-coating of the cable and the clamping part and no additional alterations to the housing are required above and beyond the recesses which are necessary in any case. An additional advantage of this development of the inventive arrangement for cable tensile strain relief is the fact that it closes the passage so as to be dampproof. The attachment of the cable tensile strain reliever to the housing—in particular when the dome is removed—may be improved still further when the housing is double-walled and the passage is formed by two pairs of contiguous recesses in housing and inner walls of the housing dome and the lower housing portion, respectively, when an annular groove is provided for each pair of recesses and when the position of the two annular grooves relative to one another is adapted to the position of the two pairs of recesses relative to one another.

In the cable tensile strain reliever having the two annular grooves, it is advantageous for the clamping part to be arranged in the region of the sheath bordered by the annular grooves.

If the passage forms an opening in the housing wall, then an advantageous development of the inventive cable tensile strain reliever is equipped in such a manner that the sheath comprises as one means an extension integrally formed directly thereon, projecting therefrom and annularly surrounding it, that a region of the sheath adjoining the one limit of the extension fits through the opening, that the extension rests against the housing wall and projects all around beyond the edge of the opening when the cable tensile strain reliever is inserted into the opening, and that the other means is attached to the said region bordering on the extension.

An excellent sealing of the connection between the housing and the cable tensile strain reliever, and, therefore, a particularly good protection against dampness, is achieved when the side wall of the extension facing the said region bordering on the extension has an overhang in such a manner that when the cable tensile strain reliever is inserted into the opening until the extension abuts on the housing wall the extension rests against the housing wall only with its outer edge facing the said region.

A particularly stable anchoring, from a mechanical point of view, of the cable tensile strain reliever in the opening is achieved when at least one hole is formed in the said region bordering on the extension and this hole extends approximately parallel to the extension and is spaced from the extension approximately at a distance equal to or greater than the thickness of the housing wall, and when a pin fitting into the hole is present as another means. The hole, as well as the extension, may be integrally formed directly during spray-coating of the clamping part and the cable portion. The pin is not inserted into the hole until the sheath has been inserted into the opening until the extension abuts on the housing wall. The pin prevents any possibility of the cable tensile strain reliever being withdrawn again out of the opening. If the distance between the extension (measured at the outer edge facing the hole) and the hole is equal to the thickness of the housing wall, the cable tensile strain reliever can no longer be moved relative to the housing and the opening is closed so as to be dampproof. The anchoring of the cable tensile strain reliever can be improved still further when two holes are provided—one on each side of the cable—and the pin is designed as a U-shaped curved clip, the distance between its arms being equal to the distance between the holes.

An additional, very stable anchoring of the cable tensile strain reliever in the opening can be obtained when an annular groove is formed in the said region bordering on the extension and this groove lies in a plane which extends approximately parallel to the extension and is spaced from the extension approximately by a distance equal to or greater than the thickness of the housing wall, and when a clip fitting into the annular groove is present as another means. The annular groove can be integrally formed directly during spray-coating of the clamping part and the cable portion. The clip is not inserted into the annular groove until the sheath is inserted into the opening until the extension abuts on the housing wall. The clip prevents any possibility of the cable tensile strain reliever being withdrawn again out of the opening. If the distance between the extension (measured at the outer edge facing the annular groove) and the annular groove is equal to the thickness of the housing wall, the cable tensile strain reliever can no longer be moved relative to the housing and the opening is closed so as to be dampproof.

It is favourable for the passage and the section parallel to the passage through the region of the sheath located in the passage to have approximately the same non-circular form. This means that the cable tensile strain reliever is secured against any rotation.

The following description of preferred embodiments of the inventive arrangement for cable tensile strain relief serves to explain the invention in greater detail in conjunction with the drawings.

Figure 2:
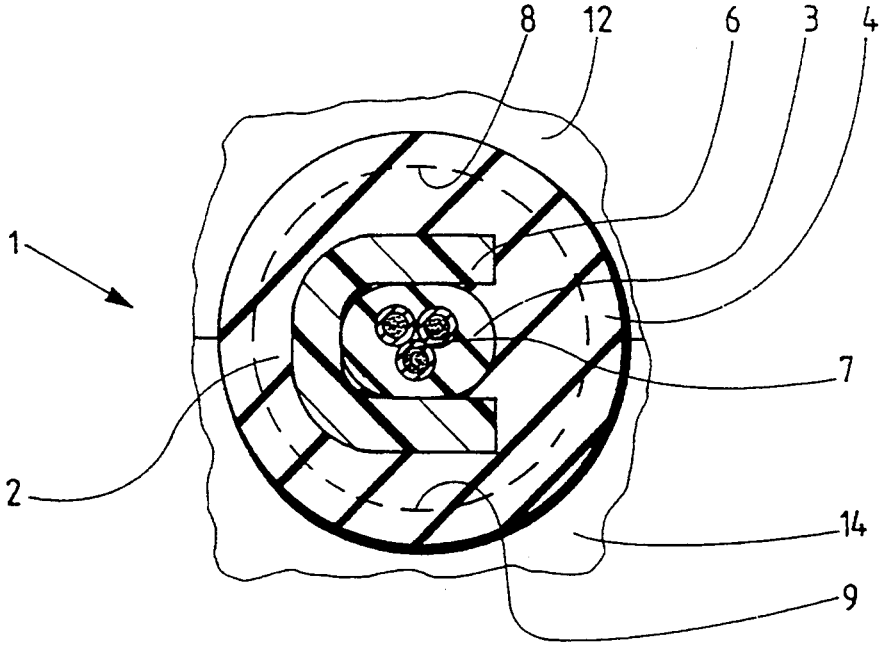
Figure 3:
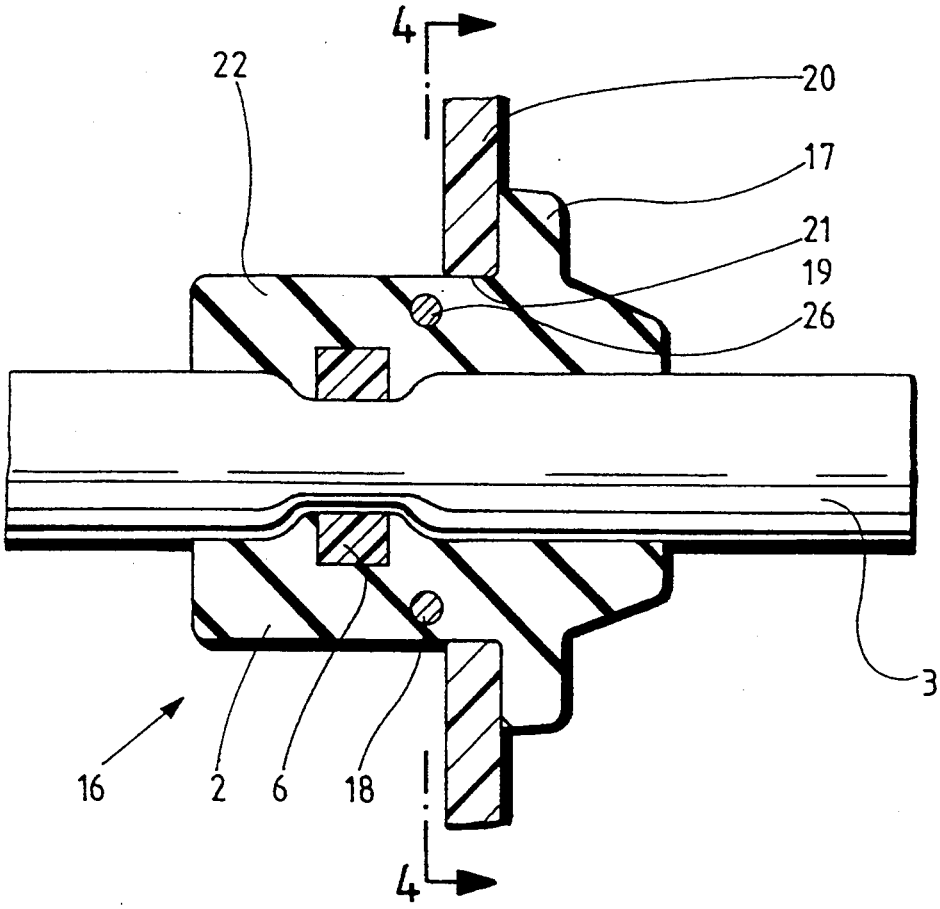
Figure 4:
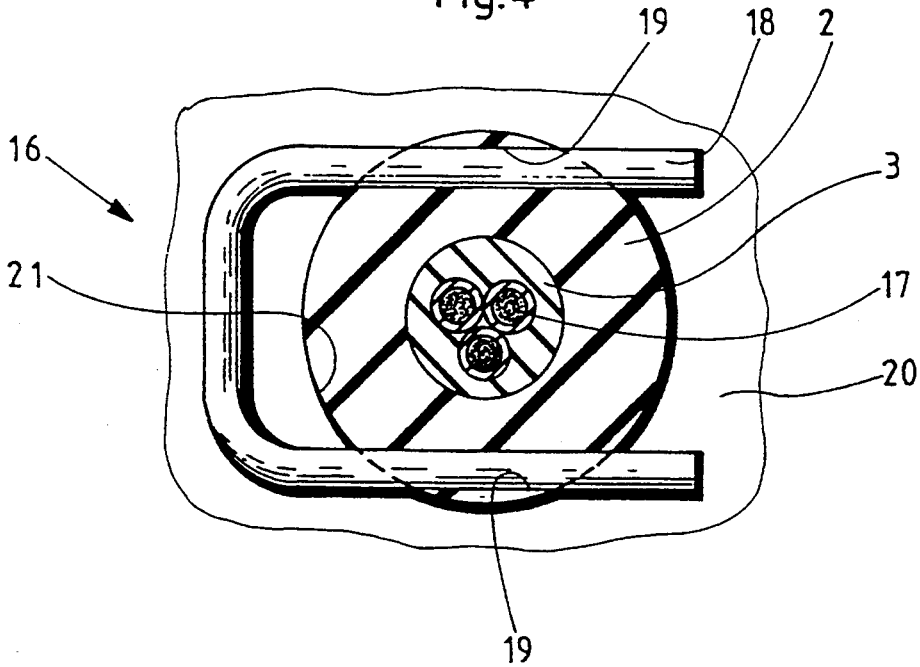
Figure 5:
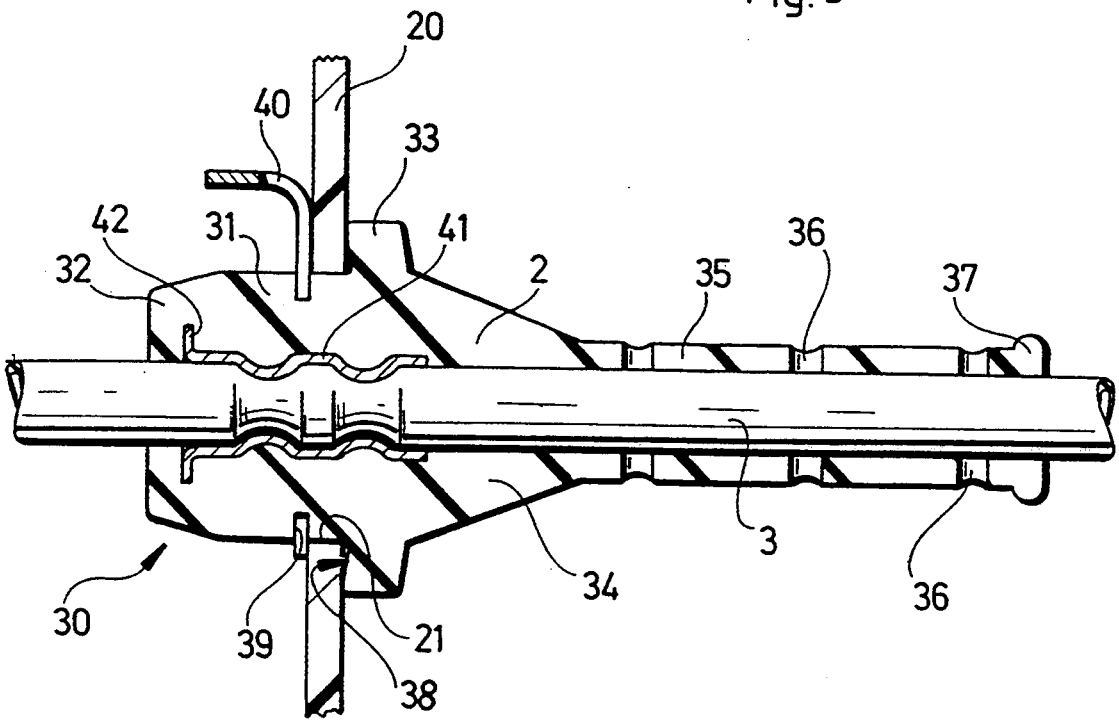
Figure 6:
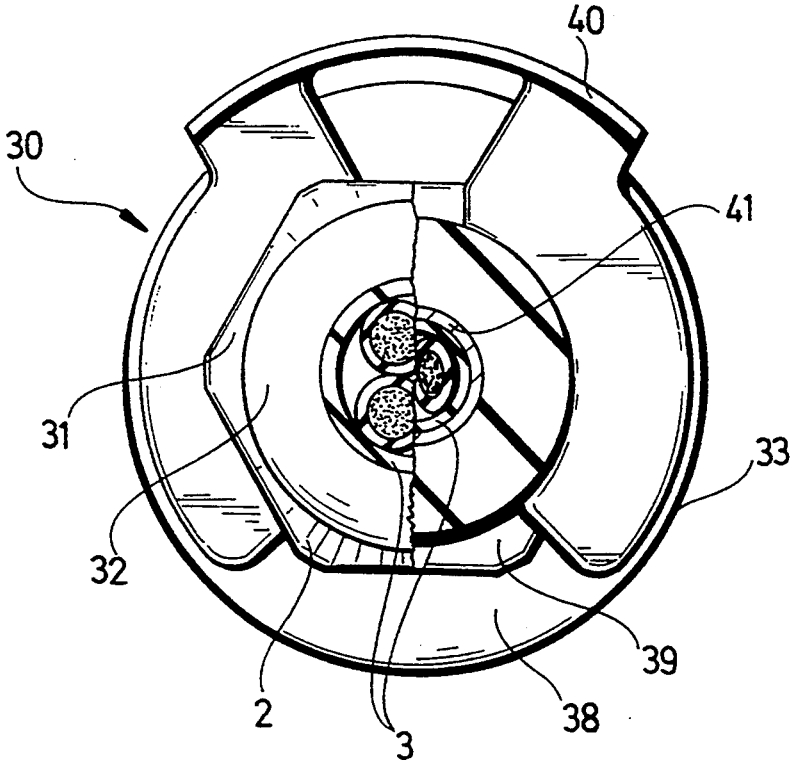

In the drawings:

FIG. 1 is a longitudinal section through one embodiment of the inventive arrangement for cable tensile strain relief, including cutaway portions of a cable and a housing wall, FIG. 2 is a cross-sectional view of the embodiment shown in FIG. 1 along the line 2—2 indicated in FIG. 1, FIG. 3 is a longitudinal section through a different embodiment of the inventive arrangement for cable tensile strain relief, including cutaway portions of a cable and a housing wall, FIG. 4 is a cross-sectional view of the embodiment shown in FIG. 3 along the line 4—4 indicated in FIG. 3, FIG. 5 is a longitudinal section through an additional embodiment of the inventive arrangement for cable tensile strain relief, including cutaway portions of a cable and a housing wall and FIG. 6 is a front view of the embodiment shown in FIG. 5 in the direction towards the outer side of the housing and partially cut away.

A cable tensile strain reliever 1 shown in FIGS. 1 and 2 belongs to a housing which consists of a housing dome and a lower housing portion and which is double-walled at least at the place where the housing dome and the lower housing portion meet, i.e., the housing dome comprises a housing wall 12 and an inner wall 13 and the lower housing portion comprises a housing wall 14 and an inner wall 15. A recess is formed in each of the facing edges of the housing and inner walls, whereby the two recesses 8 and 9 in the housing walls 12 and 14 and the two recesses 10 and 11 in the inner walls 13 and 15 lie opposite one another and complement one another to form circular openings.

The two openings form a passage for the cable and the cable tensile strain reliever 1 is fitted into this passage in the arrangement shown in FIG. 1.

The cable tensile strain reliever 1 consists of a sheath 2 and a clamping part 6. The clamping part 6 has a U-shaped profile and is placed on a cable 3. Since the distance between the arms of the clamping part 6 is smaller than the cable diameter, the cable 3 is constricted by the clamping part 6. The clamping part 6 and a cable region on both sides of the clamping part 6 are spray-coated with the sheath 2. The clamping part 6 is embedded in a circular-cylindrical region 23 of the sheath 2 having two annular grooves 4 and 5 which are located in planes at right angles to the cylinder axis, whereby the clamping part 6 is arranged between the planes. The annular grooves 4 and 5 are adapted in their dimensions and their spacing from one another to the design of the recesses 8 and 9 and 10 and 11, respectively, and their position relative to one another such that when the cable tensile strain reliever is inserted in the passage and the housing is closed, the edges of the recesses 8 and 9 fit into the annular groove 4 and the edges of the recesses 10 and 11 fit into the annular groove 5 so exactly that a mechanically stable and dampproof connection is ensured between the housing and the cable tensile strain reliever 1.

The circular-cylindrical region 23 of the sheath 2 comprising the annular grooves 4 and 5 is adjoined on one side in a step-like offset manner by an additional circular-cylindrical region and on the other side by a conical region which tapers with increasing distance from the region 23.

The sheath 2 can consist of an elastic plastic material, for example of polyvinyl chloride, polyurethane or a mixture of these two substances, or of a rubber material which is vulcanized onto the cable 3. The clamping part 6 consists of a metal or a hard plastic having a higher melting point than the material, of which the sheath 2 consists. The material, from which the clamping part 6 is produced, is permanently deformed during bending or is elastic. In the former case, the cable 3 is pressed together with the clamping part 6 during the production of the cable tensile strain reliever and then the cable region which includes the point of constricted is laid in the mold for spray-coating. In the latter case, the mold must be designed such that during the spraying the cable 3 and the clamping part 6 are pressed together and the shape of cable and clamping part thus produced is "frozen" during spray-coating. During spray-coating the desired outer shape of the sheath— including the annular grooves 4 and 5—is also integrally formed directly without any additional subsequent work being necessary.

On the housing, only the correct formation of the recesses which are required in any case is necessary. This means that not only the insertion of the cable tensile strain reliever but also the constructional measures required for this are extremely simple. Since the clamping part 6 constricts the cable 3 and thereby—in the case of multiwired cables—presses the individual wires 7 against the insulation (cf. FIG. 2), external tensile forces can no longer be transferred to the connection points in the interior of the apparatus via an individual or several individual wires. On the contrary, the tensile forces are transferred via the insulation to the clamping part 6 and from there via the sheath 2 to the housing. In this respect, it is also favourable for the clamping part 6 to be rigidly anchored in the sheath 2 on the basis of its shape.

For insertion into the housing, the cable tensile strain reliever 1 is placed, when the housing dome is removed, with the annular grooves 4 and 5 into the recesses 9 and 11 in the lower housing wall 14 and in the inner wall 15, respectively. Subsequently, the housing dome is placed in position such that the recesses 8 and 10 in the housing wall 12 and in the inner wall 13, respectively, engage in the annular grooves 4 and 5.

A cable tensile strain reliever 16 shown in FIGS. 3 and 4 belongs to a housing, in which the cable 3 is guided into the housing through a circular opening 21 in a housing wall 20.

So that the cable tensile strain reliever 16 can be inserted into the opening 21 and fixed in position therein, it must have several special constructional features, by which it is distinguished from the cable tensile strain reliever 1—but only by these features. This means that the remarks made in the above in conjunction with the description of the cable tensile strain reliever 1 concerning the clamping part 6, the sheath 2, the constriction of the cable 3, the spray-coating of the clamping part 6 and the cable 3 and also concerning the materials used, applies in exactly the same manner to the cable tensile strain reliever 16. The advantages mentioned thereby also apply, of course, to the cable tensile strain reliever 16.

The special constructional features are to be found, in particular, in the external shape of the sheath 2. This consists essentially of a circular-cylindrical region 22, the outer diameter of which is of the same size as or somewhat smaller than the diameter of the opening 21. The clamping part 6 is also embedded in the cylindrical region 22. The one end of the cylindrical region also forms the one end of the sheath 2 while the other end of the cylindrical region merges in a step-like manner into a flange-like extension 17 projecting radially in relation to the cylinder axis. This extension is followed by a truncated cone 26 tapering with increasing distance from the extension 17 and forming the other end of the sheath 2. In the arrangement shown in FIG. 3, the cable tensile strain reliever 16 is inserted into the opening 21 with the circular-cylindrical region 22 from the outside until the extension 17 abuts on the housing wall 20. In this position, the extension 17 transfers to the housing tensile forces which are exerted on the cable tensile strain reliever 16 and directed towards the interior of the housing, and ensures the protection against buckling and dampness.

A clip 18 attached to the sheath 2 prevents any possibility of the cable tensile strain reliever 16, which is inserted into the opening 21 until it engages on the housing wall, being withdrawn again and transfers to the housing any tensile forces which are exerted on the cable tensile strain reliever 16 and result when the cable is pulled from outside. The clip 18 is bent into a U shape and its arms are inserted into two through holes 19 in the sheath 2 which are parallel to one another. The distance between the holes is equal to the distance between the arms; the holes are located in a plane at right angles to the cylinder axis, are arranged on both sides of the cable and spaced from the extension 17 by a distance approximately equal to the thickness of the housing wall 20.

The outer contour of the sheath 2, including the extension 17 and the bores 19, is integrally formed directly during spray-coating of the cable 3 and the clamping part 6. The only constructional measure which has to be taken on the housing to receive the cable tensile strain reliever 16 is the opening 21 which is necessary for the passage of the cable anyway. The assembly of the cable tensile strain reliever 16 is extremely simple:

The cable tensile strain reliever is pushed into the opening 21 as far as the stop and, subsequently, the clip 18 is introduced into the holes 19. The arms of the clip 18 are of such a length that when the base of the clip 18 rests against the sheath 2, the tips of the arms protrude out of the holes 19.

A cable tensile strain reliever 30 shown in FIGS. 5 and 6 belongs, like the cable tensile strain reliever 16, to a housing, in which the cable 3 is introduced into the housing through an opening 21 in a housing wall 20. Consequently, the sheath 2 of the cable tensile strain reliever 30 displays on the outside several similarities to that of the cable tensile strain reliever 16. The sheath 2 includes, in particular, a cylindrical region 31 which merges on one side in the direction of the cylinder axis into a truncated cone 32 which tapers with increasing distance from the cylindrical region and forms the one end of the sheath 2, and on the other side in a step-like manner into a radially protruding, circular extension 33. The extension 33 is arranged coaxially to the cylindrical region 31. The side wall 38 of the extension 33 facing the cylindrical region 31 overhangs the cylindrical region 31 and forms an angle of approximately 80° with the cylinder axis. Preferably, the opening 21 and the cross section, at right angles to the cylinder axis, through the cylindrical region 31 have the same design, whereby it is particularly favourable for the outer contour of the cylindrical region 31 and, with it, the opening 21 as well to have a non-circular, e.g. hexagonal shape. The extension 33 is followed by a truncated cone 34, which tapers with increasing distance from the extension 33 and merges into a cylindrical region 35. The end of the cylindrical region 35 which is remote from the truncated cone and comprises an annular bead 37 protruding from the cylinder forms the other end of the sheath 2. Moreover, radially extending holes 36 and grooves in the form of cylinder segments extending at right angles to the cylinder axis are also introduced into the cylindrical region 35, whereby the holes and the grooves which increase the flexibility of the region 35 penetrate as far as the cable 3. A narrow annular groove 39 having a circular inner contour is inserted into the outer surface of the cylindrical region 31. This groove extends in a plane at right angles to the cylinder axis and its distance in the direction of the cylinder axis from the side wall 38 (measured at the outer edge facing the annular groove) is equal to the thickness of the housing wall. A clip 40 can be anchored in the annular groove 39. This clip 40 is a circlip made of spring steel, the yielding region of which is designed as a segment cut from a cylinder surface directed vertically to the clip. The clip 40 is dimensioned such that it can be inserted into the annular groove 39 under pressure and springs back after insertion so that it is firmly anchored in the annular groove 39.

The clip 40 is not inserted until the cable tensile strain reliever 30 has been inserted, truncated cone 32 first, starting from the interior of the housing through the opening in the housing until the extension 33 abuts on the housing wall. Once the clip 40 has been inserted, the extension 33 is pressed against the housing wall, whereby the design of the side wall 38 ensures a particular good seal and, with it, a still further improved protection against dampness. The extension 31 transfers to the housing tensile forces acting on the cable tensile strain reliever 30 and directed towards the interior of the housing while the clip 40 transfers to the housing tensile forces which act on the cable tensile strain reliever 30 and result when the cable is pulled from outside. If the cylinder region 31 and the opening on the housing wall have the same, non-circular shape, the cable tensile strain reliever 30 is also secured against rotation about the cylinder axis of the region 31. In the case of the cable tensile strain relievers 1 and 16, as well, it is advantageous to provide the same, non-circular, e.g. hexagonal, design for, on the one hand, the opening in the housing or the recesses in the housing dome and the lower housing part and, on the other hand, for the region of the sheath 2 framed by the opening and the recesses, respectively. AS in the case of the cable tensile strain reliever 16, the cable tensile strain reliever 30 also does not require any further measures, apart from the opening 21 which is required anyway, for providing a stable and sealed attachment to the housing.

The cable tensile strain reliever 30 has a clamping part 41 designed as a cylindrical sleeve, the inner diameter of which is approximately equal to the outer diameter of the cable 3. The sleeve and, with it, the cable 3 is constricted at two places. Moreover, the one end of the sleeve is bent over and designed as a flange-like expanded portion 42 protruding at right angles. The axis of the sleeve coincides with the cylinder axis of the cylindrical region 31, and the sleeve extends out of the truncated cone 32, through the cylindrical region 31 and as far as the truncated cone 34. The sleeve can also be constricted at only one place or at more than two places, and it is even possible to design both ends as flange-like expanded portions. Due to the constriction of the sleeve, the cable 3 guided through the sleeve is fixed in a mechanically stable manner in the sleeve and the clamping part 41 in the sheath 2, in particular, due to the flange-like enlargement 42 and the constrictions at the places which are pressed together. The clamping part 41 can be produced from the same materials as the clamping part 6. The clamping of the cable 3 in the clamping part 41 and the insertion of the clamping part 41 into the sleeve 2 take place in the same manner as described above in conjunction with the clamping part 6. The outer contour of the sheath 2, including the extension 31 and the annular groove 39, is integrally formed directly during the spray-coating of the cable 3 and the clamping part 41. Moreover, it is easily possible to provide a clamping part in the cable tensile strain relievers 1 and 16 which is designed in the same way as the clamping part 41, or also to provide the clamping part 6 in the cable tensile strain reliever 30.

I claim:

1. An arrangement for cable tensile strain relief comprising:

a cable;

a cable sheath;

means for attaching the arrangement to a body through which the cable is to pass, for absorbing the tensile strain; and a clamping part for constricting the cable and fixing it relative to the sheath;

wherein the clamping part rests against the cable and the sheath encloses the clamping part and a cable portion including a region constricted by the clamping part; and wherein said sheath is integrally formed onto the clamping part and the cable portion by spray-coating.

2. An arrangement for cable tensile strain relief as defined in claim 1, wherein the sheath is integrally formed onto the clamping part and the cable portion by spray-coating.

3. An arrangement for cable tensile strain relief comprising:

a cable;

a cable sheath;

means for attaching the arrangement to a body through which the cable is to pass, for absorbing the tensile strain; and a clamping part for constricting the cable and fixing it relative to the sheath;

wherein the clamping part rests against the cable and the sheath encloses the clamping part and a cable portion including a region constricted by the clamping part; and wherein the clamping part has a U-shaped profile providing two opposing arms, the distance between the arms is less than the diameter of the cable in the non-constricted state, and the cable is held between the two arms.

4. An arrangement for cable tensile strain relief as defined in claim 1, wherein the clamping part is designed as a sleeve pressed together at at least one point to such an extent that the smallest distance between opposite regions of the sleeve inner wall is less than the diameter of the cable in the non-constricted state and the cable is guided through the sleeve.

5. An arrangement for cable tensile strain relief as defined in claim 4, wherein at least one end of the clamping part has a terminal, flange-like expanded portion.

6. An arrangement for cable tensile strain relief as defined in claim 1, wherein the sheath consists of a flexible plastic material.

7. An arrangement for cable tensile strain relief as defined in claim 6, wherein the plastic material is selected from the group polyvinyl chloride, polyurethane and a mixture of the two substances.

8. An arrangement for cable tensile strain relief as defined in claim 1, wherein the sheath consists of a rubber material.

9. An arrangement for cable tensile strain relief comprising:

a cable;

a cable sheath.;

means for attaching the arrangement to a body through which the cable is to pass, for absorbing the tensile strain; and a clamping part for constricting the cable and fixing it relative to the sheath;

wherein the clamping part rests against the cable and the sheath encloses the clamping part and a cable portion including a region constricted by the clamping part; and wherein the clamping part consists of material permanently deforming during bending.

10. An arrangement for cable tensile strain relief as defined in claim 1, wherein the clamping part consists of an elastic material.

11. An arrangement for cable tensile strain relief comprising:

a cable;

a cable sheath;

means for attaching the arrangement to a body through which the cable is to pass, for absorbing the tensile strain; and a clamping part for constricting the cable and fixing it relative to the sheath;

wherein the clamping part rests against the cable and the sheath encloses the clamping part and a cable portion including a region constricted by the clamping part; and wherein the clamping part consists of a metal.

12. An arrangement for cable tensile strain relief comprising:

a cable;

a cable sheath;

means for attaching the arrangement to a body through which the cable is to pass, for absorbing the tensile strain; and a clamping part for constricting the cable and fixing it relative to the sheath;

wherein the clamping part rests against the cable and the sheath encloses the clamping part and a cable portion including a region constricted by the clamping part; and wherein the clamping part consists of a plastic material having a higher melting point than the sheath material.

13. An arrangement for cable tensile strain relief as defined in claim 1, wherein the attaching means are directly integrally formed on and/or attached to the body at the sheath.

14. An arrangement for cable tensile strain relief as defined in claim 13, wherein the attaching means form enlargements projecting from the sheath having at least two limits facing one another and are adapted to the body in such a manner that when the arrangement for cable tensile strain relief is attached to the body the two limits rest against at least one wall of the body.

15. An arrangement for cable tensile strain relief as defined in claim 14, wherein each of said limits and a region of the sheath adjacent thereto and not belonging to an enlargement engage around an edge of the wall.

16. An arrangement for cable tensile strain relief as defined in claim 15, wherein the body is designed as a housing having a passage for the cable regions of the sheath fit into the passage, and the attaching means are constructed such that they rest with said limits against walls of the housing limiting the passage when the arrangement for cable tensile strain relief is inserted into the passage.

17. An arrangement for cable tensile strain relief as defined in claim 16, wherein:

the passage is formed at least of one pair of two contiguous recesses in a housing dome and a lower housing portion, respectively;

the facing limits of the attaching means form the walls of at least one annular groove;

the annular groove has a width adapted to the thickness of the wall of the housing dome and the lower housing portion, respectively;

the outer and inner contours of the annular groove are geometrically approximately similar to the opening formed by the one pair of recesses;

the inner diameter of the annular groove is equal in size to or less than the diameter of the opening; and the outer diameter of the annular groove is greater than the diameter of the opening.

18. An arrangement for cable tensile strain relief as defined in claim 1, wherein:

the housing is double-walled and the passage is formed from two pairs of contiguous recesses, respectively, in housing and inner walls, respectively, of the housing dome and the lower housing portion, respectively;

an annular groove is provided for each pair of recesses; and the position of the two annular grooves relative to one another is adapted to the position of the two pairs of recesses relative to one another.

19. An arrangement for cable tensile strain relief as defined in claim 18, wherein the clamping element is arranged in the region of the sheath bordered by the annular grooves.

20. An arrangement for cable tensile strain relief as defined in claim 16, wherein:

the passage forms an opening in the housing wall;

the sheath comprises as one means an extension integrally formed directly thereon, projecting therefrom and annularly surrounding it;

a region of the sheath adjoining the one limit of the extension fits through the opening;

the extension projects all around beyond the edge of the opening when the arrangement for cable tensile strain relief is inserted into the opening; and another means is attached to said region bordering on the extension.

21. An arrangement for cable tensile strain relief as defined in claim 20, wherein:

the side wall of the extension facing said region bordering on the extension has an overhang in such a manner that when the cable tensile strain relief is inserted into the opening until the extension abuts on the housing wall, the extension rests against the housing wall only with its outer edge facing said region.

22. An arrangement for cable tensile strain relief as defined in claim 20, wherein:

at least one hole is formed in said region bordering on the extension, said hole extending approximately parallel to the extension and being spaced from the extension approximately at a distance equal to or greater than the thickness of the housing wall; and a pin fitting into the hole is present as another means.

23. An arrangement for cable tensile strain relief as defined in claim 22, wherein:

two holes are provided extending parallel to one another; and the pin is designed as a U-shaped curved clip having two arms, the distance between said arms being equal to the distance between the holes.

24. An arrangement for cable tensile strain relief as defined in claim 20, wherein:

an annular groove is formed in said region bordering on the extension, this groove lying in a plane approximately parallel to the extension and being spaced from the extension approximately by a distance equal to or greater than the thickness of the housing wall; and a clip fitting into the annular groove is present as another means.

25. An arrangement for cable tensile strain relief as defined in claim 16, wherein the passage and the section parallel to the passage through the region of the sheath located in the passage have approximately the same non-circular form.

* * * * *